US006480159B1

(12) United States Patent
Hsu

(10) Patent No.: US 6,480,159 B1
(45) Date of Patent: Nov. 12, 2002

(54) ANTENNA STRUCTURE FOR PDA MOBILE PHONE

(75) Inventor: Yao-Tung Hsu, Pa-Te (TW)

(73) Assignee: Auden Techno Corp., Taoyuan (TW)

( * ) Notice: Subject to any disclaimer, the term of this patent is extended or adjusted under 35 U.S.C. 154(b) by 0 days.

(21) Appl. No.: 09/940,587

(22) Filed: Aug. 29, 2001

(51) Int. Cl.[7] ..... H01Q 1/24
(52) U.S. Cl. ..... 343/702; 343/895; 455/90
(58) Field of Search ..... 343/702, 895, 343/900; 455/90, 575, 66, 556

(56) References Cited

U.S. PATENT DOCUMENTS 6,275,193 B1 * 8/2001 Nilsen et al. ..... 343/702
6,311,042 B1 * 10/2001 DeSchrijver ..... 455/66
6,380,897 B1 * 4/2002 Shaw et al. ..... 343/702

* cited by examiner

*Primary Examiner*—Don Wong
*Assistant Examiner*—Hoang Nguyen
(74) *Attorney, Agent, or Firm*—Troxell Law Office PLLC

(57) ABSTRACT

An antenna structure for a PDA mobile phone, wherein, an insulating main body of the antenna structure comprises a cap and a seat; the cap has a coil receiving chamber and a passage juxtaposed with the chamber; the seat is provided with a hole at a position in correspondence with that of the coil receiving chamber for placing therein the related coil, a metallic support and an elastic contacting piece; an insertion connecting portion and a curved open channel communicating with the passage are formed at a position in correspondence with that of the passage; when the antenna structure is mounted on an equipment, a PDA pen is adapted to inserting in position in the curved open channel as a member thereof.

5 Claims, 4 Drawing Sheets

ANTENNA STRUCTURE FOR PDA MOBILE PHONE

BACKGROUND OF THE INVENTION

1. Field of the Invention

The present invention is related to an antenna structure for a PDA mobile phone, and especially to an antenna structure of which a positioning structure for a pen of the PDA is provided.

2. Description of the Prior Art

A helical coils made from a winding metallic strip is the main element of an antenna used for signal receiving and emitting. Such a helix antenna structure can affect in all aspects the functions of the antenna. For example, in a helix antenna in a British patent No. 2,206,243, the diameter of wire made of material such as copper plated steel, the pitch of helix, the over all length etc. all affect the set proper functions of the antenna. In a mobile phone using such material of wire as an example, generally, the helix coil is placed in an inner hole of an insulating external sleeve of the body of the mobile phone in an elastically compressed state.

The mainstream of designing for modern mobile phones is miniaturization; built-in microstrip antennas gradually substitute for conventional coils. The helix antenna structures protrude from the surfaces of the communication equipments have the advantages of inexpensiveness, stability and reliability of frequency in communication etc., they are widely used thereby in various communication equipments for signal receiving and emitting.

Among the electronic equipments able to be carried with one's person, in addition to mobile phones, there are personal digital assistants (PDA). A PDA has been miniaturized, it is convenient to be carried with one's person and operated by him. Miniaturized PDAs' have gradually become the mainstream of the products of digital electronic processing devices. In view of such tendency, some mobile phone manufacturers combined the function of a PDA into a mobile phone. Such a PDA mobile phone surely is attached with a pen for operating on the screen of the PDA.

However, such an antenna structure for a PDA mobile phone needs more space for placing a pen for operating on the screen of the PDA in addition to the space for the exposed helix antenna. A PDA mobile phone available now generally has the receiving spaces for the antenna and the pen provided at two opposite sides of the PDA mobile phone; this makes the whole space of the product occupied, and surely is not benefit to further miniaturization of such product.

SUMMARY OF THE INVENTION

The object of the present invention is to provide an antenna structure for a PDA mobile phone, an insulating body of the antenna is flat with a predetermined size of volume, thereby, the constructing members such as a coil and contact pieces etc. can be assembled in the equipment, and a space of a lateral passage is left in order a pen for operating can be stored and positioned in the lateral passage as a member of the main body of the antenna.

In a preferred embodiment, the above stated space of the lateral passage starts from the top and stops at the bottom of the main body of the antenna to form an open channel and a curved stop in cooperation with a protrusion provided on the pen for operating the PDA to function as a positioning portion for placing and taking the pen.

The present invention will be apparent in its novelty and other characteristics after reading the detailed description of the preferred embodiment thereof in reference to the accompanying drawings. Wherein:

DETAILED DESCRIPTION OF THE PREFERRED EMBODIMENT

Figure 1:
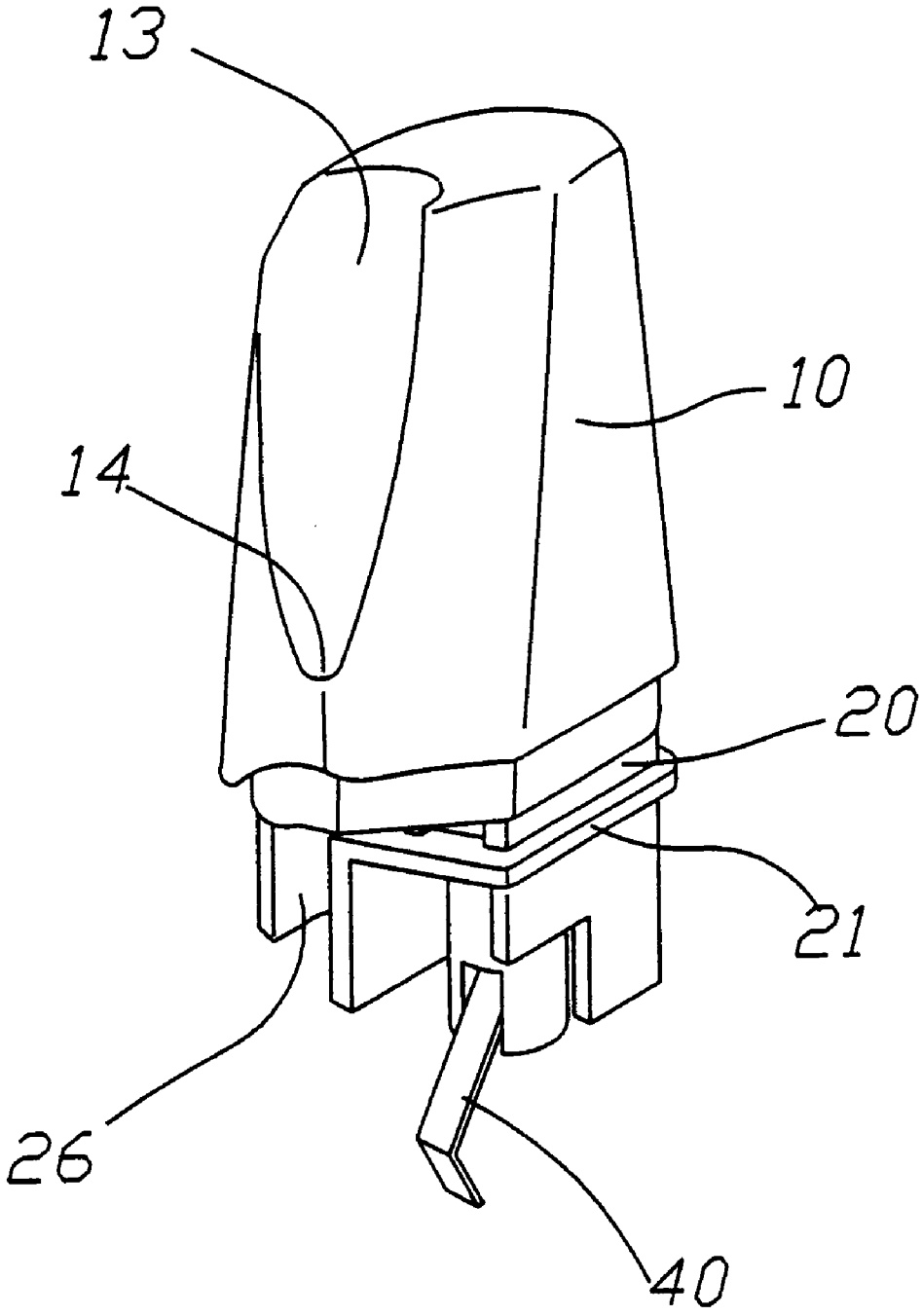
FIG. 1 is a perspective view of a preferred embodiment of the present invention.
Figure 2:
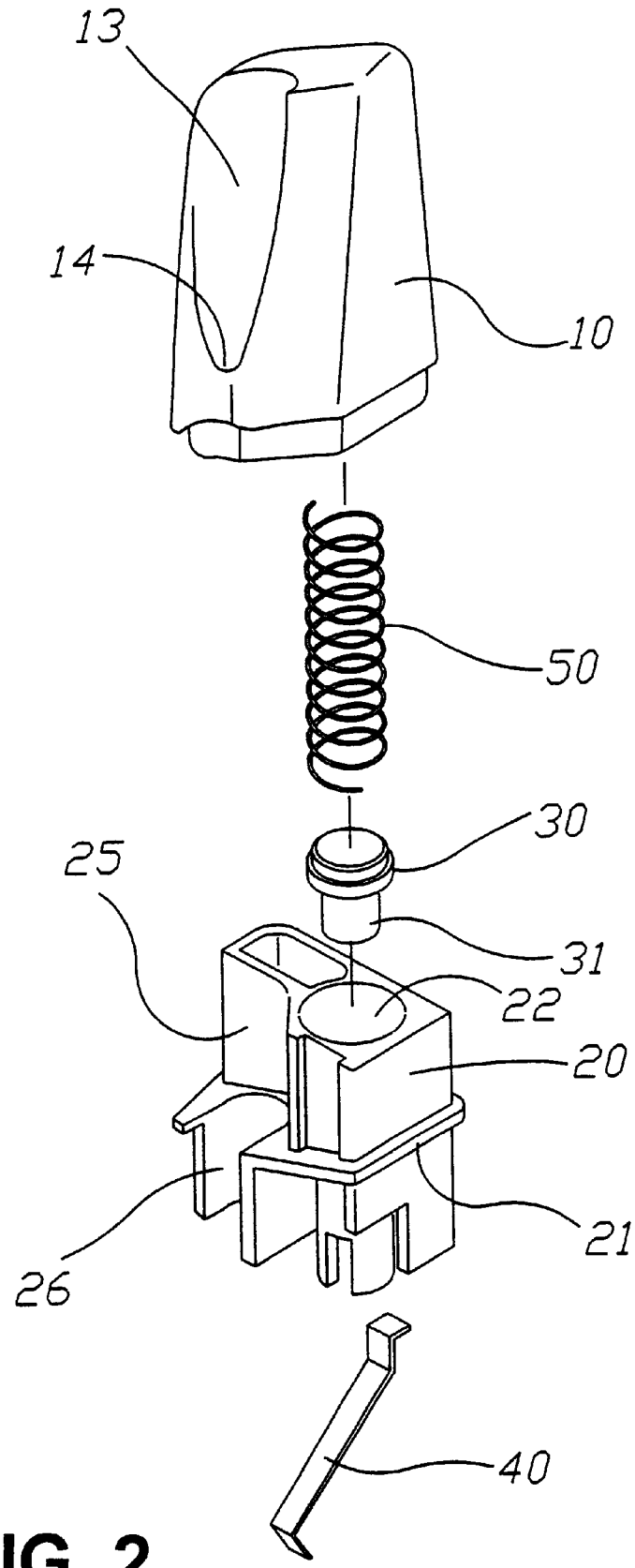
FIG. 2 is an analytic perspective view showing the elements of FIG. 1.
Figure 4:
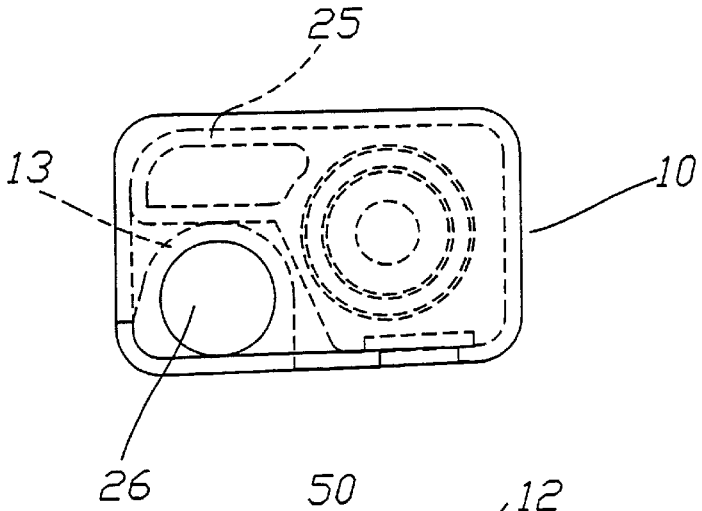
FIG. 4 is a top view of FIG. 1.
Figure 3:
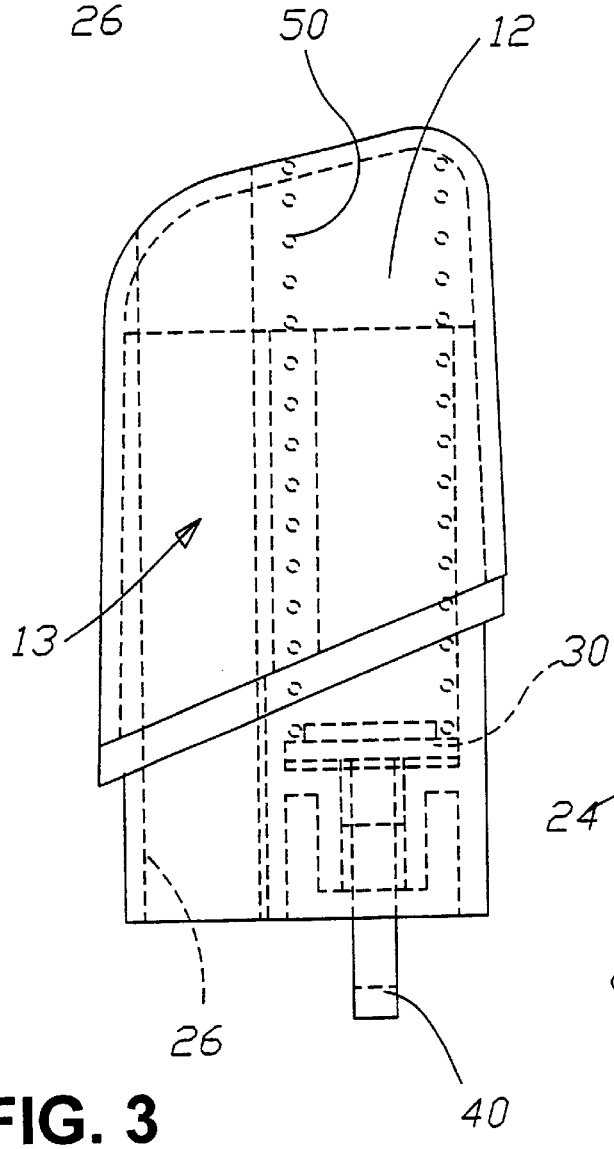
FIG. 3 is a front view of FIG. 1.

Referring to FIG. 1–5, in a preferred embodiment of the present invention, the insulating main body of the antenna structure comprises a cap 10 and a seat 20. The cap 10 is hollow with a solid top surface 11 and opening downwardly, and has a slightly larger width and a wall thickness increasing gradually downwardly. The cap 10 with a predetermined width renders itself to obtain a coil receiving chamber 12 (referring to FIG. 3) and a space for a passage 13. In the preferred embodiment shown, the passage 13 provided to match with the pen for operating the PDA extends all the way from the solid top surface 11 down to the bottom of the cap 10, by providing the wall thickness increasing gradually downwardly of the cap 10, a curved stop 14 can be formed on the external surface of the cap 10.

The seat 20 is provided with a circle of flange 21 at a predetermined height thereon to position and connect the cap 10; and has a hole 22 at a position in correspondence with that of the coil receiving chamber 12 mentioned above, the bottom of the hole 22 is reduced to form a hole 23 of a smaller diameter (referring to FIG. 5) and to form a shoulder 24 thereat. The seat 20 is provided with an insertion connecting portion 25 at a position in correspondence with that of the passage 13, and with a curved open channel 26 of which the sectional area matches with that of the passage 13.

Figure 5:
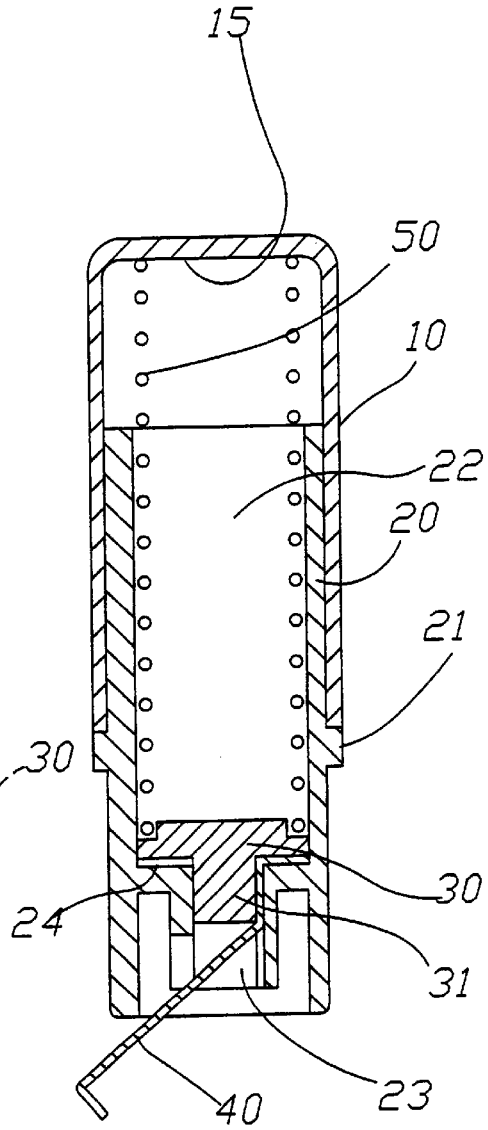
FIG. 5 is a lateral sectional view of FIG. 1.

As shown in FIGS. 1 and 5, a metallic support 30 is placed in the hole 22 with a downwardly extending axle 31 thereof inserting into the hole 23 of a smaller diameter to press contact one end of an elastic contacting piece 40, and is placed thereon with a coil 50. The bottom end of the coil 50 is pressed against the metallic support 30, and its top end is pressed against the inner top surface of the coil receiving chamber 12 of the cap 10.

Figure 6:
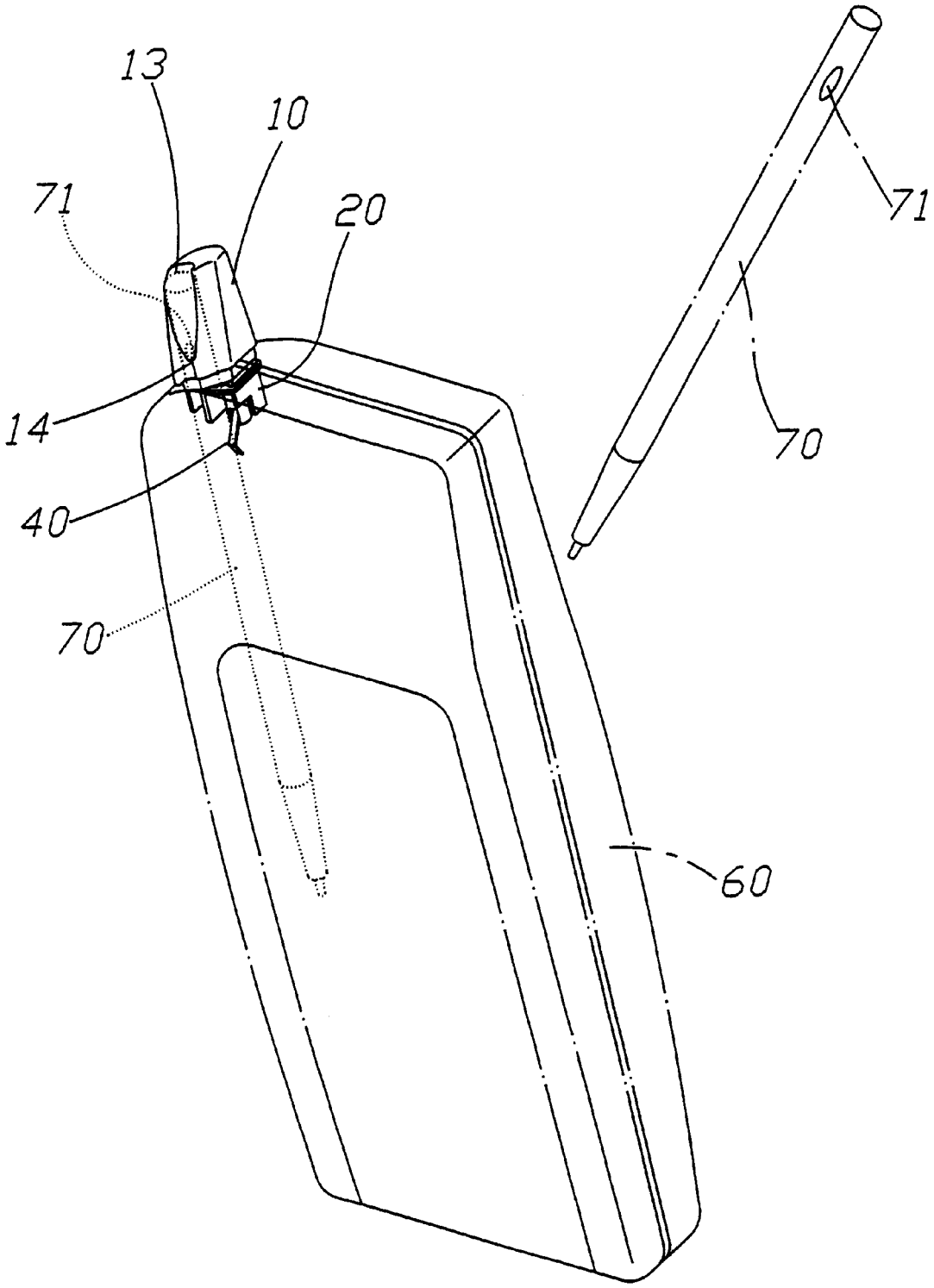
FIG. 6 is a schematic view showing mounting of the antenna structure of the present invention on a PDA mobile phone for placing and taking the pen of the PDA.

As shown in FIG. 6, when the above stated antenna structure of the present invention is mounted on the top surface of a PDA mobile phone 60, the passage 13 provided thereon and the curved open channel 26 in communication with the passage 13 can allow insertion of a PDA pen 70 on which a protrusion 71 is provided to allow the pen 70 to be positioned after it is inserted to make abutment of the protrusion 71 on the curved stop 14. And the protrusion 71 can be a force exerting point for picking out the pen 70.

The antenna of the PDA mobile phone 60 of the present invention thereby can render the pen 70 to be placed as a member of the main body of the antenna. Therefore, the allocation of space of the entire equipment can be more variant and more suitable for miniaturization of the equipment.

The preferred embodiment disclosed above is only for illustrating the present invention. It will be apparent to those skilled in this art that various modifications or changes can be made to the elements of the present invention without departing from the spirit of this invention. Accordingly, all such modifications and changes also fall within the scope of the appended claims and are intended to form part of this invention.

What is claimed is:

1. An antenna structure for a PDA mobile phone, wherein, an insulating main body of said antenna structure comprises a cap and a seat; said cap is hollow with a solid top surface and opening downwardly, and has a coil receiving chamber and a passage juxtaposed with said chamber; said seat is provided with a hole at a position in correspondence with that of said coil receiving chamber for placing therein said related coil, a metallic support and an elastic contacting piece; an insertion connecting portion and a curved open channel communicating with said passage are formed at a position in correspondence with that of said passage; when said antenna structure is mounted on an equipment, a PDA pen is adapted to inserting in position in said curved open channel.

2. An antenna structure for a PDA mobile phone as defined in claim 1, wherein, said cap has a wall thickness increasing gradually downwardly, a curved stop is formed at said passage on the external surface of said cap.

3. An antenna structure for a PDA mobile phone as defined in claim 2, wherein, said PDA pen has a protrusion thereon to allow said pen to be positioned at said curved stop.

4. An antenna structure for a PDA mobile phone as defined in claim 1, wherein, said hole of said seat is communicated with a hole of a smaller diameter, in order that said metallic support is placed thereon and a downwardly extending axle of said metallic support is inserted therein to press contact one end of an elastic contacting piece at a shoulder formed at the junction of said hole of said seat and said hole of said smaller diameter by the force of a coil placed on said metallic support.

5. An antenna structure for a PDA mobile phone as defined in claim 4, wherein, the bottom end of said coil is pressed against the inner bottom surface of said metallic support, and its top end is pressed against the inner top surface of said coil receiving chamber of said cap.

* * * * *